US008113121B2

(12) United States Patent
Roop

(10) Patent No.: US 8,113,121 B2
(45) Date of Patent: Feb. 14, 2012

(54) GUIDEWAY SYSTEM TO ROADWAY INTERCHANGE SYSTEM

(75) Inventor: Stephen S. Roop, College Station, TX (US)

(73) Assignee: The Texas A&M University System, College Station, TX (US)

( * ) Notice: Subject to any disclaimer, the term of this patent is extended or adjusted under 35 U.S.C. 154(b) by 103 days.

(21) Appl. No.: 12/248,762

(22) Filed: Oct. 9, 2008

(65) Prior Publication Data

US 2009/0095189 A1 Apr. 16, 2009

Related U.S. Application Data

(60) Provisional application No. 60/978,952, filed on Oct. 10, 2007.

(51) Int. Cl.
*B61B 1/00* (2006.01)

(52) U.S. Cl. ..... 104/29; 410/1

(58) Field of Classification Search ..... 104/27, 104/29, 30, 31, 48, 49; 105/3, 355, 370, 105/455; 410/10; 414/339, 349, 672
See application file for complete search history.

(56) References Cited

U.S. PATENT DOCUMENTS

| | | | | |
|---|---|---|---|---|
| 3,490,389 | A * | 1/1970 | Brown | 414/577 |
| 3,516,368 | A * | 6/1970 | Wright | 105/455 |
| 3,534,688 | A * | 10/1970 | Max | 104/35 |
| 3,581,918 | A * | 6/1971 | Fujioka | 414/395 |
| 3,584,584 | A * | 6/1971 | Milenkovic | 410/1 |
| 3,884,158 | A * | 5/1975 | Rumell | 410/1 |
| 3,916,799 | A * | 11/1975 | Smith | 410/1 |
| 4,129,079 | A * | 12/1978 | Shannon | 410/1 |
| 4,425,064 | A * | 1/1984 | Walda et al. | 410/1 |
| 4,671,714 | A * | 6/1987 | Bennett | 410/57 |
| 4,776,735 | A * | 10/1988 | Walda et al. | 410/1 |
| 4,780,033 | A * | 10/1988 | Walda et al. | 410/1 |
| 4,880,341 | A * | 11/1989 | Van Den Pol | 410/1 |
| 4,948,310 | A * | 8/1990 | Ord | 410/1 |
| 5,988,073 | A * | 11/1999 | Eriksson | 105/355 |
| 6,279,483 | B1 * | 8/2001 | Murray et al. | 104/29 |
| 2008/0271634 | A1 * | 11/2008 | Eriksson | 105/355 |
| 2009/0095189 | A1 * | 4/2009 | Roop | 104/29 |

FOREIGN PATENT DOCUMENTS

DE 202 19 382 U1 4/2003

OTHER PUBLICATIONS

PCT Notification of Transmittal of the International Search Report and the Written Opinion of the International Searching Authority, or the Declaration, regarding PCT Application No. US2008/079502 (13 pages), Dec. 23, 2008.

* cited by examiner

*Primary Examiner* — Joe Morano, IV
*Assistant Examiner* — Jason C Smith
(74) *Attorney, Agent, or Firm* — Baker Botts L.L.P.

(57) ABSTRACT

According to one embodiment, a transport interchange system includes a roadway that intersects a guideway system such that the roadway is discontinuous across the guideway system. A guideway vehicle is provided that transports an intermodal container over the guideway system. The guideway vehicle is operable to rotate the intermodal container from a first position in which the intermodal container is parallel to the roadway to a second position in which the intermodal container is parallel to the guideway vehicle.

18 Claims, 3 Drawing Sheets

GUIDEWAY SYSTEM TO ROADWAY INTERCHANGE SYSTEM

RELATED APPLICATIONS

This application claims priority to U.S. Provisional Patent Application Ser. No. 60/978,952, entitled "GUIDEWAY SYSTEM TO ROADWAY INTERCHANGE SYSTEM," which was filed on Oct. 10, 2007.

TECHNICAL FIELD OF THE DISCLOSURE

This disclosure generally relates to freight transport guideway systems, and more particularly, to a transport guideway system to a roadway interchange system.

BACKGROUND OF THE DISCLOSURE

Transport of products from a producer to consumers of these products may be provided by various transport mechanisms, such as trucks that travel over a roadway or by guideway vehicles that travel over a guideway system. Transport by guideway system may be beneficial for large quantities of product shipped over relatively long distances. Transport by truck however, may be more beneficial for distribution of products over relatively shorter distances.

SUMMARY OF THE DISCLOSURE

According to one embodiment, a transport interchange system includes a roadway that intersects a guideway system such that the roadway is discontinuous across the guideway system. A guideway vehicle is provided that transports an intermodal container over the guideway system. The guideway vehicle is operable to rotate the intermodal container from a first position in which the intermodal container is parallel to the roadway to a second position in which the intermodal container is parallel to the guideway vehicle.

Embodiments of the disclosure may provide numerous technical advantages. Some, none, or all embodiments may benefit from the below described advantages. According to one embodiment, the transport interchange system provides a relatively more efficient mode of transferring intermodal containers than known transportation interchange systems. The transport interchange system of the present disclosure provides a rotatable cargo platform that allows intersection with a roadway such that intermodal containers may be positioned over the guideway vehicle using typical trucks. Thus, intermediary steps for transferring intermodal containers, such as lifting operations provided by cranes, may be eliminated or reduced for increasing the speed and efficiency in which these intermodal containers may be transferred between roadway and guideway system. Additionally, because the roadway is configured at an angle relative to the path of the guideway vehicle, it may be designed to be well suited for travel by trucks that haul intermodal containers. Thus, the roadway intersecting the guideway system may incorporate sufficient width and other elements, such as railings, to reduce human error caused by improper handling of intermodal containers during the transferal procedure.

Other technical advantages will be apparent to one of skill in the art.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

A guideway system is a particular form of transportation technique in which guideway vehicles are guided along a predetermined path using guideway. Transport by either guideway system or by truck may each provide distinct advantages. To utilize the advantages provided by these differing modes of transport, product may be interchanged between trucks that travel over a roadway and guideway vehicles that travel over the guideway system. Known approaches for interchanging product have included overhead cranes that are configured to transfer containers from one transport mechanism onto another. This approach, however, is generally inefficient in that the container must be structurally designed to handle lifting stresses placed on the container at its attachment points. That is, many trailers typically configured for transport along roadways do not have a chassis structure suitable for lifting by crane. Additionally, the sequence of operations used for interchanging containers between trucks and guideway vehicles using overhead cranes may be relatively time consuming.

Figure 1:
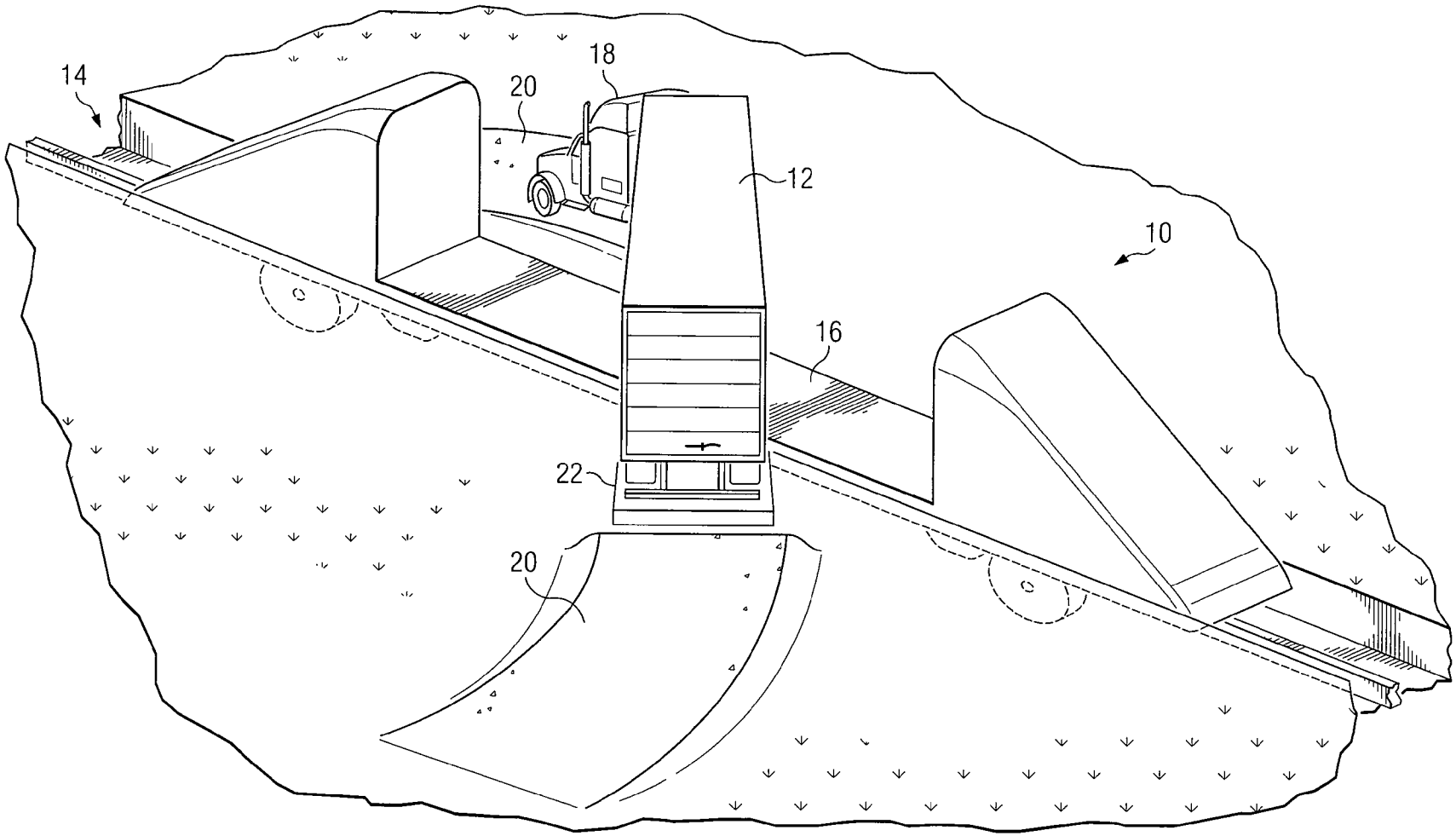
FIG. 1 is a perspective view of one embodiment of a transport interchange system according to the teachings of the present disclosure.

FIG. 1 shows one embodiment of a transport interchange system 10 that may provide a solution to this problem as well as other problems. Transport interchange system 10 generally includes an intermodal container 12 that may be transported over a guideway system 14 by a guideway vehicle 16 and a truck 18 over a roadway 20. As will be described in detail below, guideway vehicle 16 has a rotatable cargo platform 22 that is rotatingly coupled to a base 17 of guideway vehicle 16 for rotating intermodal container 12 from a first position that is generally parallel with the roadway 20 to a second position that is generally parallel with the guideway vehicle 16.

Certain embodiments of guideway vehicle 16 having a rotatable cargo platform 22 may provide an advantage over other known approaches for interchanging product between trucks and guideway vehicles. Known product interchange approaches include overhead cranes that typically use a cabling structure to lift intermodal containers 12 during movement, an operation that allows these intermodal containers 12 to dangle during movement. This dangling characteristic of movement is typically unstable, thus requiring slow, deliberate movements in order to avoid damage to the container or product stored inside. The rotatable cargo platform 22 according to the present disclosure may avoid this generally inefficient approach by enabling relatively stable transferal of intermodal container 12 between roadway 20 and guideway vehicle 16 while still coupled to a chassis that is well suited for travel over a roadway.

Intermodal container 12 may be any suitable container for housing product during shipment. In one embodiment, intermodal container 12 may be configured for transport using a semi-trailer truck 18 and guideway vehicle 16 without additional housing mechanisms. That is, intermodal container 12 may be transported by semi-trailer truck 18 or guideway vehicle 16 without placement in another housing structure. In one embodiment, intermodal container 12 may include attachment points for interchanging between other trucks and guideway vehicles using an overhead crane when a transport interchange system 10 according to the teachings of the present disclosure is not available.

Figure 2:
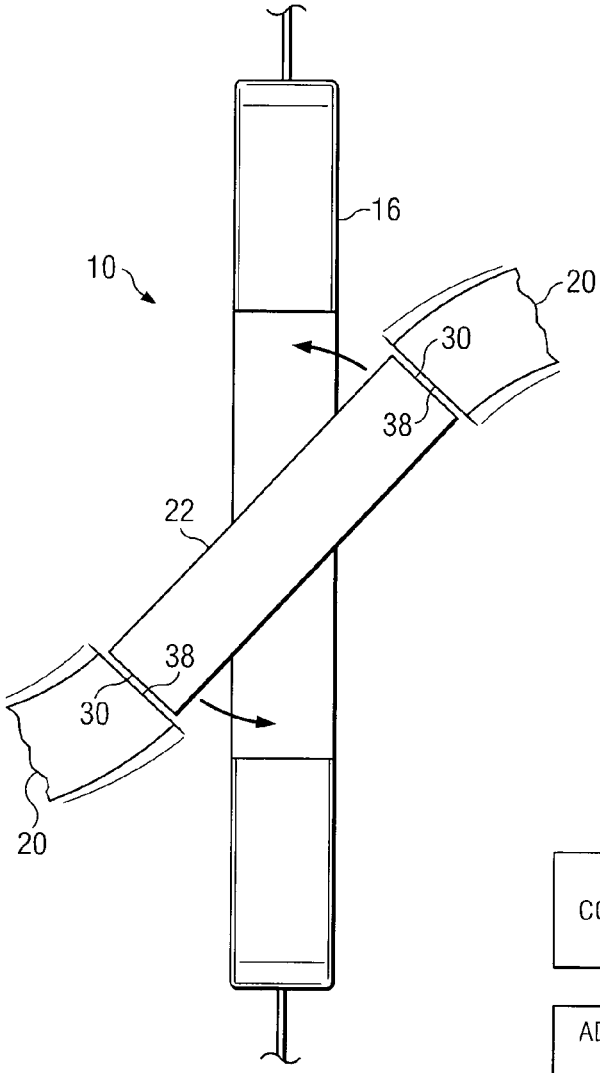
FIG. 2 is a top view of the embodiment of FIG. 1 in which the intermodal container has been removed to reveal its rotatable cargo platform that is in the first position parallel to the roadway.

FIG. 2 is a top view of the embodiment of FIG. 1 in which the intermodal container 12 has been removed to reveal rotatable cargo platform 22 that is in the first position. In the first position, rotatable cargo platform 22 is aligned with the roadway 20 such that intermodal container 12 may be rolled onto rotatable cargo platform 22 via the roadway 20.

Guideway system 14 intersects roadway 20 such that roadway 20 is discontinuous across guideway system 14 forming two roadway edges 38. These two roadway edges 38 may be disposed in a manner to allow free movement of guideway vehicle 16 along guideway system 14 without interference. Roadway edges 38 are configured such that when rotatable cargo platform 22 is rotated to the second position, its two ends 30 may be relatively close to roadway edges 38. In this manner, intermodal container 12 may be pulled onto the rotatable cargo platform 22 using truck 18.

Roadway 20 intersects guideway system 14 at any suitable angle. In the particular embodiment shown, roadway 20 intersects guideway system 14 at approximately thirty degrees; however, the roadway 20 may intersect the guideway system 14 at any suitable angle that allows relatively free movement of truck 18 and intermodal container 12 across guideway system 14. Certain embodiments having a relatively small intersecting angle between the guideway system 14 and roadway 20 may provide an advantage in that intermodal containers 12 may be transferred from the roadway 20 to guideway system 14 in a relatively quick and efficient manner.

Figure 3:
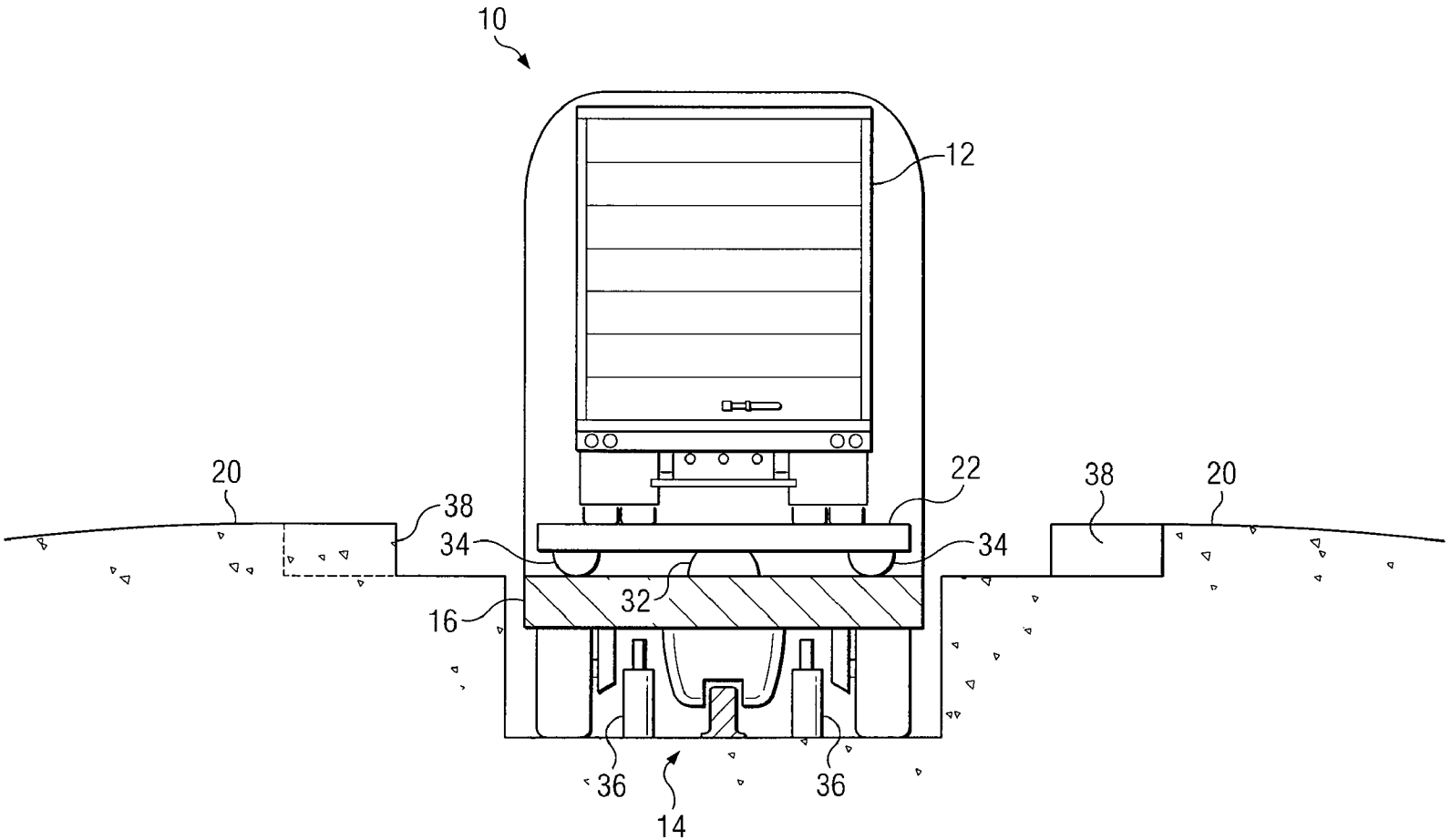
FIG. 3 is a side elevational, cross-sectional view of the transport interchange system of FIG. 1 in which rotatable cargo platform is in the second position parallel to the guideway system.

FIG. 3 is a side elevational, cross-sectional view of transport interchange system 10 of FIG. 1 in which rotatable cargo platform 22 is in the second position. In the second position, rotatable cargo platform 22 is aligned with guideway vehicle 16 such that intermodal container 12 may be transported over guideway system 14.

Rotatable coupling of rotatable cargo platform 22 may be provided by a pivoting assembly 32 disposed between rotatable cargo platform 22 and guideway vehicle 16. In one embodiment, pivoting assembly 32 includes a center-bowl mechanism that allows pivoting of rotatable cargo platform 22 relative to guideway vehicle 16. According to another embodiment, wheeled roller devices 34 may be provided proximate both ends 30 (FIG. 2) of rotatable cargo platform 22. Each wheeled roller device 34 includes a wheel for support of the ends 30 of rotatable cargo platform 22.

In one embodiment, transport interchange system 10 includes a height adjustment mechanism 36 for adjusting the height of guideway vehicle 16 relative to roadway 20. In many cases, variations in the weight of intermodal container 12 may cause its overall height to vary such that rotatable cargo platform 20 does not vertically align well with roadway edges 38. Height adjustment mechanism 36 adjusts the height of guideway vehicle 16 such that rotatable cargo platform 20 is essentially at the same elevation as roadway edges 38 when rotatable cargo platform 20 is in the first position.

Figure 4:
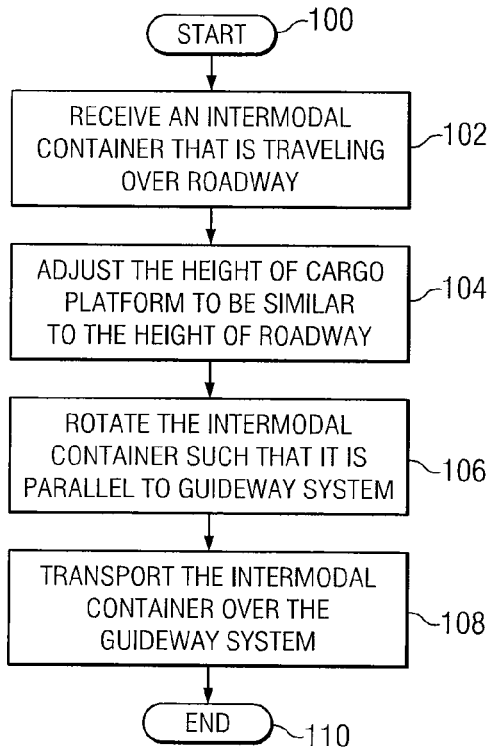
FIG. 4 is a flowchart showing a series of actions that may be performed by the transport interchange system of FIG. 1 to interchange the intermodal container from transport over the roadway to transport over the guideway system.

FIG. 4 is a flowchart showing one embodiment of a series of actions that may be performed to interchange intermodal container 12 from transport over roadway 20 to transport over guideway system 14. In act 100, the process is initiated.

In act 102, guideway vehicle 16 receives an intermodal container 12 that has been transported over roadway 20. Intermodal container 12 may be transported over roadway 20 using any suitable roadway transportation system, such as a semi-trailer truck that is releasably coupled to intermodal container 12.

In act 104, the height of guideway vehicle 16 may be adjusted so that rotatable cargo platform 20 is at essentially the same elevation as roadway ends 38. In a particular embodiment, a height adjustment mechanism, such as one or more hydraulic pistons disposed underneath guideway vehicle 16. These hydraulic pistons operate under manual or automated control to push upwards on guideway vehicle 16 to thus proportionally adjust its height relative to roadway 20.

In act 106, intermodal container 12 is rotated such that it becomes parallel to guideway vehicle 16 for travel along guideway system 14. In one embodiment, guideway vehicle 16 includes a rotatable cargo platform 20 that is rotates over a pivot assembly, such as a center bowl mechanism. Rotatable cargo platform 20 may also have roller devices 34 on both ends for support of rotatable cargo platform 20 during rotation the position parallel to the guideway system 14.

In act 108, intermodal container 12 is transported over guideway system 14 using guideway vehicle 16. In this manner, guideway system 14 transports intermodal container 12 to any desired distant location. When transport intermodal container 12 by guideway system 14 is complete, acts 102 through 106 may be performed in reverse to transfer intermodal container 12 from guideway vehicle 16 to transport over roadway 20. In act 110, the process ends.

Modifications, additions, or omissions may be made to the previously described method without departing from the scope of the disclosure. The method may include more, fewer, or other acts. For example, rotation of rotatable cargo platform 20 may be accomplished by a transmission that couples rotational power from the drive motor of guideway vehicle using a direct mechanical linkage or by a hydraulic power transmission device. As another example, rotation of rotatable cargo platform 20 may be accomplished using a rotational drive mechanism disposed external to guideway vehicle 16. In this manner, complexity and thus costs associated with construction and maintenance of guideway vehicle 16 may be mitigated in some embodiments.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. A transport interchange system comprising:

a guideway vehicle operable to transport an intermodal container over a guideway system comprising a central guideway rail that substantially aligns with a midpoint of the guideway vehicle and is configured to direct the path traveled by the guideway vehicle, the guideway system intersecting a roadway that is traversed by an intermodal container, the guideway vehicle including a rotatable cargo platform that is operable to:

support the intermodal container; and rotate the intermodal container from a first position parallel to the roadway to a second position parallel to the guideway vehicle, the rotatable cargo platform abutting a first edge and a second edge of the roadway while in the first position; and wherein the guideway system over which guideway vehicle is transported comprises a height adjustment mechanism coupled to the ground beneath the guideway system, the height adjustment mechanism adjustably coupling to the guideway vehicle and operable to adjust the height of the guideway vehicle while in the first position such that the rotatable cargo platform is at essentially the same elevation as the first edge and the second edge of the roadway.

2. The transport interchange system of claim 1, wherein the height adjustment mechanism comprises one or more hydraulic pistons coupled to the ground beneath the guideway system, the one or more hydraulic pistons operating to push upwards on the guideway vehicle and adjust the height of the guideway vehicle relative to the roadway.

3. A transport interchange system comprising:

a guideway vehicle operable to transport an intermodal container over a guideway system comprising a central guideway rail that substantially aligns with a midpoint of the guideway vehicle and is configured to direct the path traveled by the guideway vehicle, the guideway system intersecting a roadway that is traversed by an intermodal container, the guideway vehicle operable to:

rotate the intermodal container from a first position in which the intermodal container is parallel to the roadway to a second position in which the intermodal container is parallel to the guideway vehicle, wherein the guideway system over which guideway vehicle is transported comprises a height adjustment mechanism coupled to the ground beneath the guideway system, the height adjustment mechanism adjustably coupling to the guideway vehicle and operable to adjust the height of the guideway vehicle while in the first position such that the rotatable cargo platform is at essentially the same elevation as the first edge and the second edge of the roadway.

4. The transport interchange system of claim 3, wherein the guideway vehicle includes a rotatable cargo platform that is operable to support the intermodal container, and rotate the intermodal container from the first position to the second position, the rotatable cargo platform abutting a first edge and a second edge of the roadway while in the first position.

5. The transport interchange system of claim 4, wherein the guideway vehicle includes a center-bowl mechanism for rotatingly coupling the rotatable cargo platform to a base of the guideway vehicle.

6. The transport interchange system of claim 4, wherein the rotatable cargo platform has two ends, each of the two ends having at least one roller device that is operable to support its respective end when the rotatable cargo platform is rotated relative to the guideway vehicle.

7. The transport interchange system of claim 3, wherein the guideway system intersects the roadway at approximately thirty degrees.

8. The transport interchange system of claim 3, wherein the intermodal container comprises a semi-trailer that is operable to be transported over the roadway by a semi-trailer truck.

9. The transport interchange system of claim 3, wherein the height adjustment mechanism comprises one or more hydraulic pistons coupled to the ground beneath the guideway system, the one or more hydraulic pistons operating to push upwards on the guideway vehicle and adjust the height of the guideway vehicle relative to the roadway.

10. A transport interchange method comprising:

receiving a guideway vehicle traveling over a guideway system comprising a central guideway rail that substantially aligns with a midpoint of the guideway vehicle, the central guideway rail configured to direct the path traveled by the guideway vehicle;

using a height adjustment mechanism coupled to the ground beneath the guideway system over which the guideway vehicle travels to couple to the guideway vehicle and adjust the height of the guideway vehicle to height that is at essentially the same elevation as a roadway;

receiving, by the guideway vehicle, an intermodal container that is traveling over the roadway;

rotating the intermodal container from a first position parallel to the roadway to a second position parallel to the guideway vehicle; and transporting the intermodal container over a guideway system by the guideway vehicle.

11. The method of claim 10, wherein receiving the intermodal container comprises receiving the intermodal container on a rotatable cargo platform of the guideway vehicle, and wherein rotating the intermodal container comprises rotating, by the rotatable cargo platform, the intermodal container from the first position abutting a first edge and a second edge of the roadway to the second position.

12. The method of claim 11, wherein receiving the intermodal container comprises receiving the intermodal container on the rotatable cargo platform, the rotatable cargo platform rotating the intermodal container from the second position to the first position.

13. The method of claim 11, wherein adjusting the height of the guideway vehicle comprises adjusting the height of the guideway vehicle while the intermodal container is in the first position such that the rotatable cargo platform is at essentially the same elevation as the first edge and the second edge of the roadway.

14. The method of claim 11, wherein rotating the rotatable cargo platform comprises rotating the rotatable cargo platform using a center-bowl mechanism.

15. The method of claim 11, wherein rotating the rotatable cargo platform comprises rotating the rotatable cargo platform using at least one roller device coupled at each of the two ends of the rotatable cargo platform, the at least one roller device supporting its respective end of the rotatable cargo platform.

16. The method of claim 10, wherein rotating the intermodal container from the first position parallel to the roadway to the second position comprises rotating the intermodal container approximately thirty degrees.

17. The method of claim 10, further comprising transporting the intermodal container over the roadway using a semi-trailer truck.

18. The method of claim 10, wherein using the height adjustment mechanism comprises causing one or more hydraulic pistons coupled to the ground beneath the guideway system to push upwards on the guideway vehicle and adjust the height of the guideway vehicle relative to the roadway.

* * * * *